US006883489B2

(12) United States Patent
Hochwald

(10) Patent No.: US 6,883,489 B2
(45) Date of Patent: Apr. 26, 2005

(54) ROTATIONAL ENGINE

(76) Inventor: Eric Hochwald, 39001 W. 12 Mile Rd., Farmington Hills, MI (US) 48331

( * ) Notice: Subject to any disclaimer, the term of this patent is extended or adjusted under 35 U.S.C. 154(b) by 122 days.

(21) Appl. No.: 10/453,778

(22) Filed: Jun. 3, 2003

(65) Prior Publication Data

US 2004/0244764 A1 Dec. 9, 2004

(51) Int. Cl.[7] ..... F02B 53/00

(52) U.S. Cl. ..... 123/243; 418/266; 418/264; 418/111

(58) Field of Search ..... 123/243, 241; 418/266, 256, 253, 264, 111

(56) References Cited

U.S. PATENT DOCUMENTS

| | | | | | |
|---|---|---|---|---|---|
| 1,142,544 | A | * | 6/1915 | Vernon et al. | 418/266 |
| 3,301,233 | A | * | 1/1967 | Dotto et al. | 123/243 |
| 4,018,191 | A | * | 4/1977 | Lloyd | 123/243 |
| 4,454,844 | A | * | 6/1984 | Kinsey | 123/236 |
| 5,277,158 | A | * | 1/1994 | Pangman | 123/243 |
| 5,415,141 | A | * | 5/1995 | McCann | 123/243 |
| 5,540,199 | A | * | 7/1996 | Penn | 123/243 |
| 5,634,783 | A | * | 6/1997 | Beal | 418/264 |
| 5,711,268 | A | * | 1/1998 | Holdampf | 123/243 |
| 6,244,240 | B1 | * | 6/2001 | Mallen | 123/243 |
| 6,250,280 | B1 | * | 6/2001 | Miller | 123/243 |
| 6,659,067 | B1 | * | 12/2003 | Al-Hawaj | 123/243 |

FOREIGN PATENT DOCUMENTS

| | | | | |
|---|---|---|---|---|
| GB | 2249139 | A | * 4/1992 | F01C/19/00 |

* cited by examiner

*Primary Examiner*—Thai-Ba Trieu
(74) *Attorney, Agent, or Firm*—Clark Hill PLC

(57) ABSTRACT

A rotational engine that includes an annular cylinder block having an inner elliptical shape. A circular member having a number of cylinder heads is positioned centrally within the annular cylinder block. Upper and lower cylinder walls are positioned in recesses formed on the top and bottom surfaces of the annular cylinder block. Cylinder gates are disposed between the adjacent cylinder heads and extend radially to contact an inner surface of the annular cylinder block. The cylinder heads and upper and lower cylinder walls are coupled such that they rotate as a unit in response to an ignition of a fuel mixture.

3 Claims, 2 Drawing Sheets

ROTATIONAL ENGINE

FIELD OF THE INVENTION

The present invention relates to internal combustion engines and, more particularly, to a rotational internal combustion engine.

DESCRIPTION OF THE RELATED ART

Internal combustion engines have been used for over a century to power various devices, including automobiles. Typically, an internal combustion engine includes a piston reciprocally moving inside a cylinder and connected to a drive mechanism using a crankshaft and connecting rod. The standard reciprocating engine generally has a small mechanical and fuel efficiency. Various factors in the reciprocating engine's inefficiency include: the incomplete combustion of fuel and the premature detonation of a fuel and air mixture resulting in a loss of power. Inherent design inefficiencies such as excessive motion of the air-fuel mixture and internal components, high friction losses, and vibration among others losses contribute to this. Typically, reciprocating engines are complicated and require complicated manufacturing processes, as well as trained service technicians. Also, typical internal combustion engines occupy a large amount of space in comparison to the power produced by such an engine. Therefore, there is a need in the art for an engine that is easy to manufacture, as well as occupies a reduced amount of space while producing an increased amount of power relative to typical reciprocating internal combustion engines.

SUMMARY OF THE INVENTION

A rotational engine, including an annular cylinder block having outer, inner, top and bottom surfaces. The inner surface has an elliptical shape. A circular member having a number of cylinder heads positioned adjacent each other is disposed centrally within the annular cylinder block. The cylinder heads include bores formed through the cylinder heads. An upper cylinder wall is positioned in a recess that is formed on the top surface of the annular cylinder block. The upper cylinder wall includes bores formed therein that are aligned with the bores formed in the cylinder heads. A lower cylinder wall is positioned in a recess formed on the bottom surface of the annular cylinder block and also includes bores that are aligned with the bores of the cylinder heads. A plurality of cylinder gates are disposed between adjacent cylinder heads. The plurality of cylinder gates extend radially from the center and contact the inner surface of the annular cylinder block. The plurality of cylinder heads and the upper and lower cylinder walls rotate as a coupled unit in response to ignition of a fuel mixture within combustion chambers of the rotational engine.

BRIEF DESCRIPTION OF THE DRAWINGS

Other objects, features, and advantages of the invention will become apparent from the following detailed description taken in conjunction with the accompanying drawings in which.

DETAILED DESCRIPTION OF THE PREFERRED EMBODIMENTS

Figure 1:
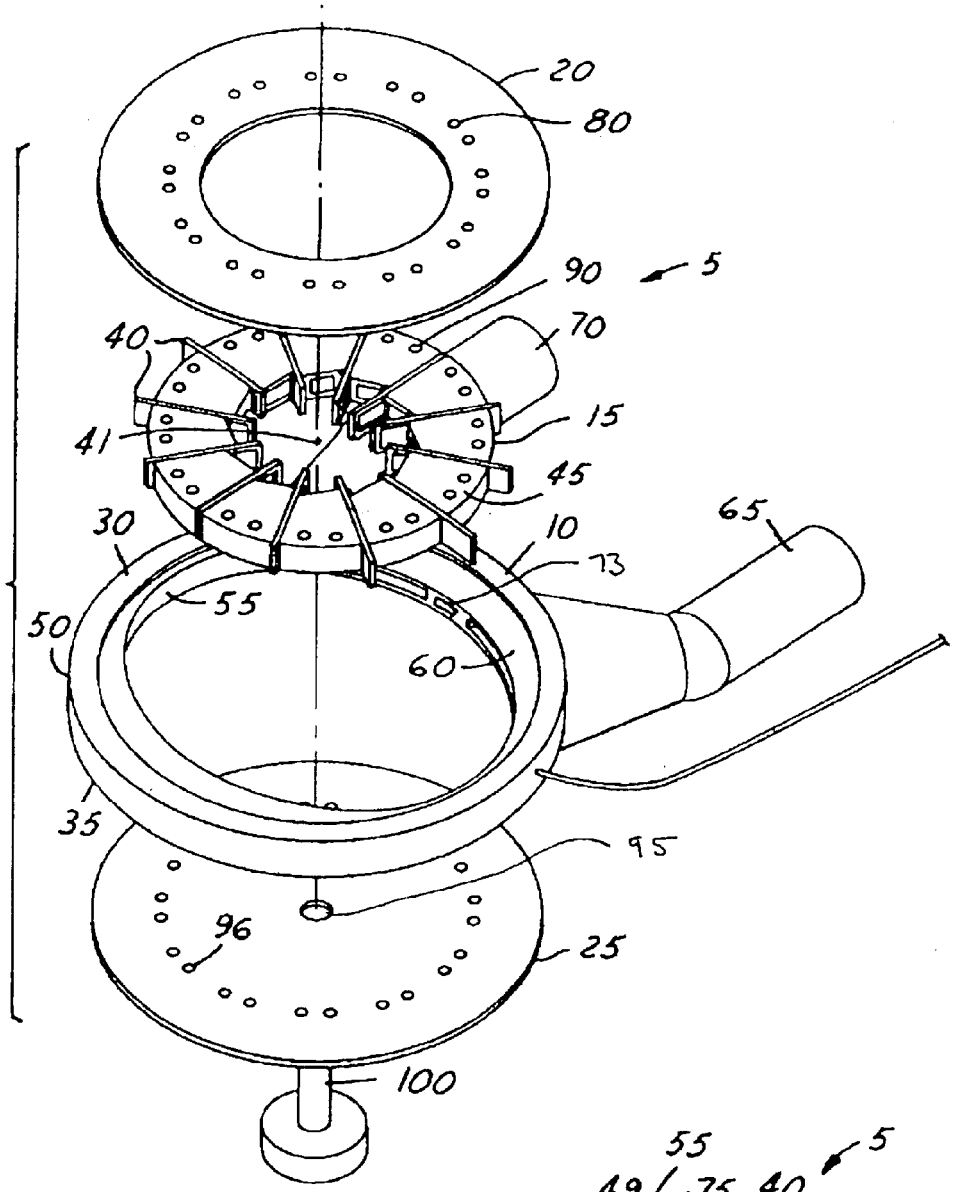
FIG. 1 is an exploded, perspective view detailing the rotational engine of the present invention.
Figure 2:
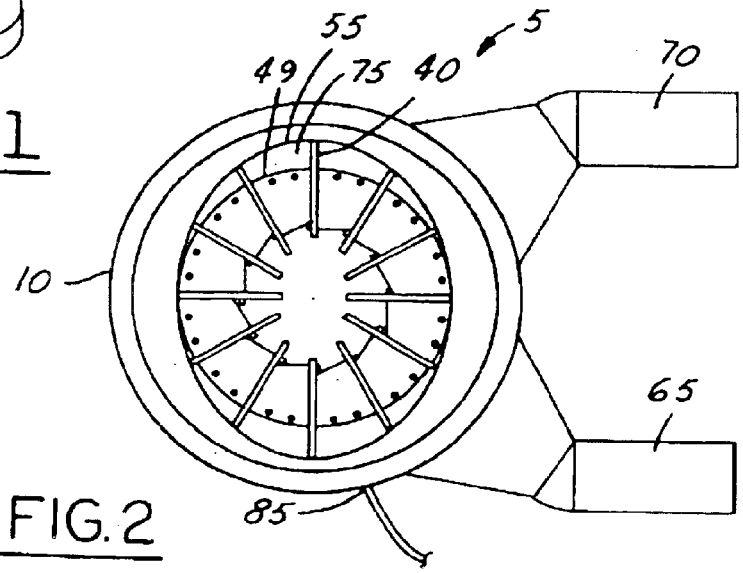
FIG. 2 is a top view of an assembled rotational engine detailing the combustion chamber.

Referring to FIGS. 1 and 2, there is shown a rotational engine 5 according to the present invention. The rotational engine 5 comprises an annular cylinder block 10, a circular member 15 disposed in the cylinder block 10, upper 20 and lower 25 cylinder walls positioned on top 30 and bottom 35 surfaces of the cylinder block 10 and a plurality of cylinder gates 40 disposed between adjacent cylinder heads 45 of the circular member 15.

Figure 3:
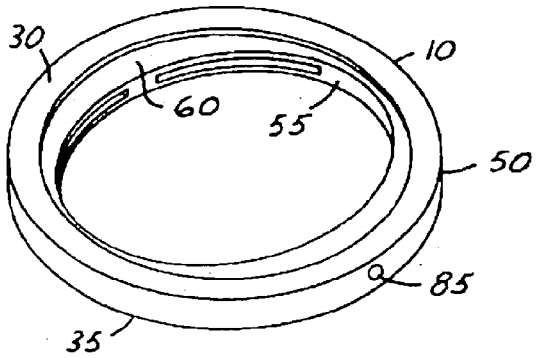
FIG. 3 is a perspective view of the annular cylinder block of the rotational engine of the present invention.

As can be seen in FIGS. 1 and 3, the annular cylinder block 10 includes outer 50, inner 55, top 30 and bottom 35 surfaces. The inner 55 surface has an elliptical shape into which the circular member 15 is received, as will be described in more detail below. The top 30 and bottom 35 surfaces include circular recesses 60 for receiving the upper 20 and lower 25 cylinder walls. The annular cylinder block 10 also includes intake 65 and exhaust 70 ports formed through the thickness of the cylinder block 10 from the outer 50 surface to the inner 55 surface. The intake 65 and exhaust 70 ports allow for transporting air into and exhaust out of combustion chambers 75 of the rotational engine 5. The cylinder block 10 further includes a spark plug port 80 and a fuel injection port 85 for transporting fuel into the combustion chambers 75 and igniting it as part of the combustion cycle.

As stated above, the upper cylinder wall 20 is positioned in a recess 60 formed on the top surface 30 of the annular cylinder block 10. The upper cylinder wall 20 generally comprises a disc shaped member and includes bores 80 formed through the upper cylinder wall 20 and are aligned with bores 90 formed in cylinder heads 45, as will be discussed in more detail below. The lower cylinder wall 25 is positioned in the recess 60 formed on the bottom surface 35 of the annular cylinder block 10. The lower cylinder wall 25 generally comprises a circular member that include bores 96 aligned with the bores 90 of the cylinder heads 45 and the bores 80 of the upper cylinder wall 20, again, as will be discussed in more detail below. The lower cylinder wall 25 also includes a bore 95 formed in a center of the lower cylinder wall 25 for receiving a drive shaft 100 for transmitting the rotation of the engine 5 to an appropriate gearing system. In a preferred aspect, the drive shaft 100 may be coupled to the bottom cylinder wall 25 using a shear pin or other mechanism, as is commonly used in the art to couple a drive shaft with an engine. Alternatively, the top 20 and bottom 25 cylinder walls may be reversed wherein the drive shaft 100 is coupled to the top 20 cylinder wall as opposed to the bottom 25 cylinder wall.

Figure 4:
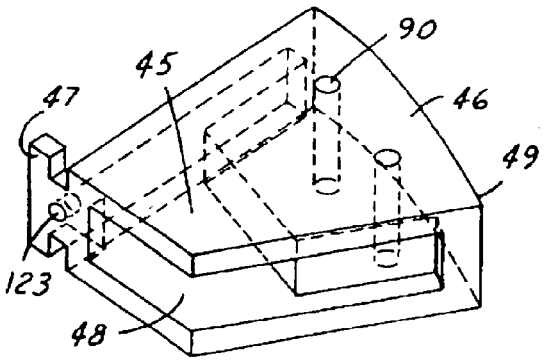
FIG. 4 is a perspective view of a cylinder head.

Referring to FIGS. 1 and 4, a circular member 15 comprising a plurality of cylinder heads 45 positioned adjacent each other is disposed centrally within the annular cylinder block 10. The cylinder heads 45, as shown individually in FIG. 4, include bores 90 formed therethrough that align with the bores 80, 96 of the upper 20 and lower 25 cylinder walls as described above. An appropriate fastener or retaining device is placed through the bores 80, 90, 96 to couple the plurality of cylinder heads 45 with the upper 20 and lower 25 cylinder walls such that they rotate as a coupled unit in response to an ignition of a fuel mixture within combustion chambers 75 of the rotational engine 5. As seen in FIG. 4, each cylinder head 45 comprises a wedge shape body 46 that includes an extension flange 47 for mating with a cylinder gate 40, as will be described below. In a preferred aspect, the cylinder head 45 may include a hollow interior 48 to reduce the overall weight of the rotational engine 5 while still maintaining sufficient strength to resist the forces of a combustion cycle. In a preferred aspect, the cylinder heads 45 may be formed of steel or other appropriate materials commonly used for cylinders in the engine art. In a preferred aspect of the present invention, the front surface 49 of the cylinder head 45 includes a concave depression 51 for concentrating the combustion of a fuel mixture as it is ignited during the combustion cycle.

Referring to FIG. 1, it can be seen that a plurality of the cylinder heads 45 are arranged in a circular fashion to form the circular member 15 previously described. The cylinder heads 45 are placed adjacent to each other with the extension flange 47 of.one of the cylinder heads 45 nesting or mating with a back surface 52 of the adjacent cylinder head 45. As shown in FIG. 1, 12 cylinder heads 45 are disposed in a circular arrangement thereby defining a 12-chamber, 1-cylinder rotational engine, including 12 combustion chambers 75, as will be described in more detail below.

Figure 5:
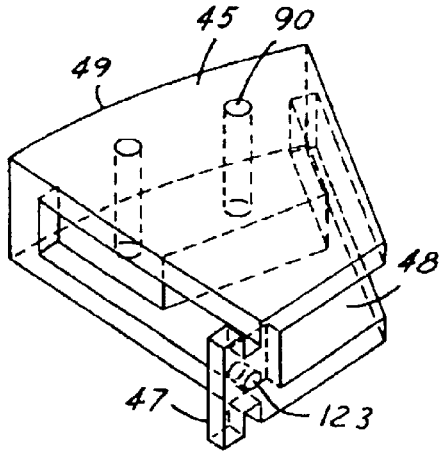
FIG. 5 is a perspective view of a cylinder head.
Figure 6:
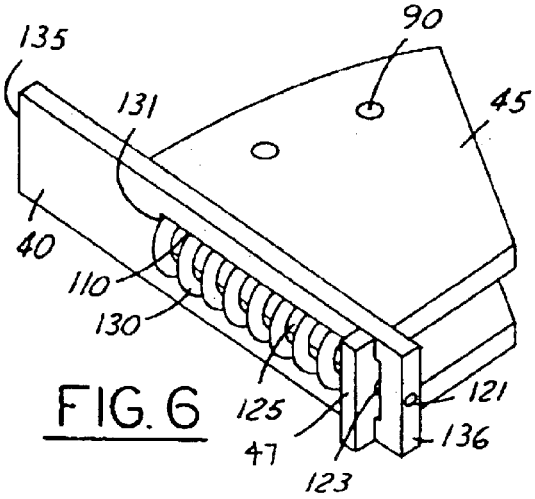
FIG. 6 is a perspective view of a cylinder head and cylinder gate.
Figure 7:
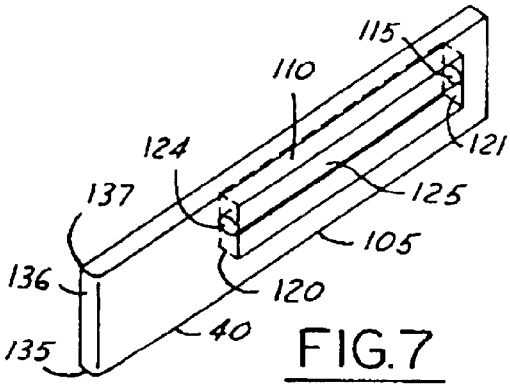
FIG. 7 is perspective view of a cylinder gate for use by the rotational engine of the present invention.

Referring to FIG. 1, there is shown a plurality of cylinder gates 40 disposed between adjacent cylinder heads 45 of the circular member 15 described above. The plurality of cylinder gates 40 extend radially from a center 41 of the rotational engine and contact the inner surface 55 of the annular cylinder block 10. Referring to FIG. 6, each cylinder gate 40 comprises a rectangular member 105 having a channel 110 formed therein that mates with the extension flange 47 of the cylinder head 45. In a preferred aspect, the channel 110 includes slots 115 formed on opposing ends 120, 121 for receiving a channel cylindrical member 125. As best seen in FIG. 5, the channel cylindrical member 125 is disposed within the channel 110 of the cylinder gate 40 and is received by the extension flange 47. A spring 130 is disposed around the channel cylindrical member 125 for biasing the cylinder gate 40 against the inner surface 55 of the cylinder block 10. In this manner, fuel and combustion gases are prevented from escaping from the combustion chamber 75. As seen in FIG. 6, the cylinder gate 40 includes a front surface 135 for engaging the inner surface 55 of the cylinder block 10. The front surface 135 comprises a planar portion 136 bounded by curved radiuses 137 for facilitating smooth and consistent mating of the inner surface 55 of the cylinder block 10 during rotation of the engine.

Referring to FIG. 5, the cylinder gate 40 is positioned to mate with the cylinder head 45 such that the channel 110 in the cylinder gate 40 is positioned to intersect the T-shape extension flange 47 of the cylinder head 45. The channel cylindrical member 125 is then passed through a back end 121 of the cylinder gate 40 and through a corresponding slot 123 formed in the extension flange 47 and terminating in a slot 124 formed in a front portion 120 of the channel 110. As stated above, a spring 130 is positioned around the channel cylindrical member 125 with a back end 131 of the spring 130 engaging the extension flange and the front end 132 of the spring 130 engaging a front surface of the channel 110. In this manner, a biasing force is applied to the cylinder gate 40 such that the front surface 135 constantly maintains contact with the inner surface 55 of the annular cylinder block 10.

Referring to FIG. 2, combustion chambers 75 defined by the intersection of the front surface 49 of the cylinder head 45, the inner surface 55 of the cylinder block 10, an interior surface 21 of the upper cylinder wall 20, and an interior surface 26 of the lower cylinder wall 25. FIG. 5 has the upper 20 and lower 25 cylinder walls partially removed for the sake of clarity for showing the combustion chambers 75 associated with each of the cylinder heads 45. The combustion chambers 75 receive fuel from the fuel injection port 85 and air from the intake port 65 at appropriate positions around a periphery of the annular cylinder block 10. The air and fuel combine to form an air-fuel mixture that is compressed and ignited as is standard in a combustion cycle.

Again, referring to FIG. 2, it can be seen that there are 12 cylinder heads 45 forming 12 separate combustion cycles, which allow 12 combustion cycles through one rotation of the circular member 15 within the annular cylinder block 10. After an air-fuel mixture is received within a combustion chamber 75, the cylinder head rotates about a center axis, the air-fuel mixture is compressed as in a traditional compression cycle of an internal combustion engine; whereafter, it is ignited by the spark plug at a position before the maximum compression of the air-fuel mixture. After firing of the air-fuel mixture, the cylinder head 45 continues to rotate through an exhaust cycle at which point the combustion gases produced by the combustion cycle exit through the exhaust port 70. The firing of the air-fuel mixture releases energy that is translated to a rotational force due to the geometric relationship of the circular member 15 comprising a plurality of cylinder heads 45 placed within an elliptical annular shaped cylinder block 10.

An approximate compression ratio of the rotational engine 5 is the largest distance from a front surface 49 of the cylinder head 45 to the elliptical inner surface 55 of the annular cylinder block 10 compared to the narrowest distance between the front surface of the cylinder head to the elliptical inner surface 55 of the annular cylinder block 10. It is an approximation due to the varying compression due to the depression on the front surface 49 or the cylinder head 45 and because of the change in the angle of the curved surface of the cylinder block 10. The presence of the depression on the front surface 49 would reduce the compression ratio below 10:1 because of the additional volume taken up by the depression. In a preferred aspect of this present invention, a compression ratio of at least 10 to 1 is utilized. Due to the high rotations per minute produced by the rotational engine 5, the timing of the firing of the spark plug may be advanced before maximum compression to increase the overall efficiency of the rotational engine 5. The ignition timing may be computer controlled or the spark location may be moved to obtain different firing sequences as dictated by a specific design.

Exhaust gas re-circulation or EGR can also be utilized by the rotational engine 5 such that various ratios of exhaust gas can be recirculated based on a distance between the front face 49 of the cylinder head 45 in relationship to the elliptical inner surface 55 of the annular cylinder block 10 at a position of the exhaust port 70. By changing the position of the exhaust port 70, various EGR ratios can be achieved. Alternatively, changing the ratios of the distance between the front face 49 of the cylinder head 45 in relationship to the elliptical inner surface 55, by creating a depression (not shown) in the inner surface 55 of the annular cylinder block 10 between the positions of the exhaust 70 and intake 65 ports, various EGR ratios can be achieved. A moving mechanical depression, or slot 73, similar to another intake port, with a solid mass filling the port can be utilized to allow for dynamically re-configurable EGR ratios.

The position of the intake port 65 is designed to allow for unrestricted airflow. The intake port preferably extends from a position where the last cylinder head 45 of the plurality would be just past the intake port 65 as the cylinder head 45 reaches maximum air-fuel volume at the 90° position. To provide optimal airflow for the rotational engine 5, assigning the reference angle of 0° to be located exactly in the middle point between the intake 65 and exhaust 70 ports on the inner 55 or the annular cylinder 10, the intake port 65 opening is located at positions between 15° and 75°, likewise the exhaust port 70 opening is located at −15°(+345°) to −75°(+285)° on inner surface 55 of the annular cylinder 10, as a mirror of the intake port 65.

In a preferred aspect of the present invention, the center portion 50 defined by the arrangement of the plurality of cylinder heads 45 includes an oil reservoir for providing lubrication of the rotational engine. Oil channels (not shown) running on the same plane as the gates 40 can be utilized to distribute oil throughout the engine 5 to prevent seizing due to frictional forces of the various components upon each other.

Referring to a specific example according to the present invention, an engine having a total fuel chamber displacement of 822 cubic centimeters (0.822 L) is disclosed. The total fuel chamber displacement relates to a maximum volume of 0.0685 L per chamber, and a compression ratio of 10.7:1, which equates to a compressed volume of 0.0064 L. This design, due to its smooth and balanced motion is expected to be capable of engine rotation speeds in excess of 15,000 rpm (rotations per minute). At 15,000 rpm, this correlates to an air-fuel consumption rate of 12,330 L/minute. This consumption rate is comparable to a conventional 5.0 L engine at approximately 4900 rpm, which would be capable of approximately 300+horsepower (223 KW). Due to the smooth motion of the design and the increases in efficiency, it is anticipated that this design could deliver in excess of 400 hp (298 KW) at 15,000 rpm, with a further potential for much higher rotational speeds. The total mass of this reference engine design is 32.35 Kg (71.33 LB) if constructed entirely of steel. Overall dimensions are 405 mm (~16") wide (without accounting for intake/exhaust ports), 405 mm (~16") long, and 44 mm (~1.75") thick from the top of the upper surface of the upper cylinder wall, to the bottom of the lower surface of the lower cylinder wall. This compares very favorably to the 5.0 L engine, which weighs in excess of 250 Kg, and has dimensions greater than 1 m×0.8 m×0.6 m. At this power level the specific power density per unit mass for this engine is 12.36 hp/Kg (9.21 KW/Kg, 5.6 hp/LB 0.18 LB/hp), compared with about 1.2 hp/Kg (0.89 KW/Kg, 0.54 hp/LB, 1.84 LB/hp) for the 5.0 L engine. This is a 10 fold power to weight ratio improvement. This engine was designed with an overall volume of about 0.007 square meters, compared with a volume of ~0.48 square meters for the conventional engine, a ~68 times reduction in space.

While preferred embodiments are disclosed, a worker in this art would understand that various modifications would come within the scope of the invention. Thus, the following claims should be studied to determine the scope and content of the invention.

What is claimed:

1. A rotational engine comprising:

an annular cylinder block having outer, inner, top and bottom surfaces, the inner surface having an elliptical shape;

a circular member comprising a plurality of cylinder heads positioned adjacent each other and disposed centrally within the annular cylinder block, the cylinder heads including bores formed there through wherein the cylinder heads comprise a truncated slice shaped body including an extension flange;

an upper cylinder wall positioned in a recess formed on the top surface of the annular cylinder block, the upper cylinder wall including bores formed therein aligned with the bores formed in the plurality of cylinder heads;

a lower cylinder wall positioned in a recess formed on the bottom surface of the annular cylinder block, the lower cylinder wall including bores aligned with the bores of the plurality of cylinder heads;

a plurality of cylinder gates disposed between adjacent cylinder heads of the plurality of cylinder heads, the plurality of cylinder gates extending radially and contacting the inner surface of the annular cylinder block and wherein the cylinder gate comprises a rectangular member having a channel formed therein and a channel cylindrical member disposed within the channel and received by the extension flange;

the plurality of cylinder heads and the upper and lower cylinder walls rotating as a coupled unit in response to an ignition of a fuel mixture within combustion chambers of the rotational engine.

2. A rotational engine comprising:

an annular cylinder block having outer, inner, top and bottom surfaces, the inner surface having an elliptical shape;

a circular member comprising a plurality of cylinder heads positioned adjacent each other and disposed centrally within the annular cylinder block, the cylinder heads including bores formed there through wherein the cylinder heads comprise a truncated slice shaped body including an extension flange;

an upper cylinder wall positioned in a recess formed on the top surface of the annular cylinder block, the upper cylinder wall including bores formed therein aligned with the bores formed in the plurality of cylinder heads;

a lower cylinder wall positioned in a recess formed on the bottom surface of the annular cylinder block, the lower cylinder wall including bores aligned with the bores of the plurality of cylinder heads;

a plurality of cylinder gates disposed between adjacent cylinder heads of the plurality of cylinder heads, the plurality of cylinder gates extending radially and contacting the inner surface of the annular cylinder block and wherein the cylinder gate comprises a rectangular member having a channel formed and a channel cylindrical member disposed within the channel and received by the extension flange and a spring disposed around the channel cylindrical member for biasing each of the cylinder gates against the inner surface of the cylinder block;

the plurality of cylinder heads and the upper and lower cylinder walls rotating as a coupled unit in response to an ignition of a fuel mixture within combustion chambers of the rotational engine.

3. A rotational engine comprising:

an annular cylinder block having outer, inner, top and bottom surfaces, the inner surface having an elliptical shape;

a circular member comprising a plurality of cylinder heads positioned adjacent each other and disposed centrally within the annular cylinder block, the cylinder heads including bores formed there through;

an upper cylinder wall positioned in a recess formed on the top surface of the annular cylinder block, the upper cylinder wall including bores formed therein aligned with the bores formed in the plurality of cylinder heads;

a lower cylinder wall positioned in a recess formed on the bottom surface of the annular cylinder block, the lower cylinder wall including bores aligned with the bores of the plurality of cylinder heads;

a plurality of cylinder gates disposed between adjacent cylinder heads of the plurality of cylinder heads, the plurality of cylinder gates extending radially and contacting the inner surface of the annular cylinder block wherein the cylinder gate includes a front surface for engaging the inner surface of the cylinder block, the front surface comprising a planar portion bounded by radiuses for preventing gouging of the inner surface of the cylinder block during rotation of the engine;

the plurality of cylinder heads and the upper and lower cylinder walls rotating as a coupled unit in response to an ignition of a fuel mixture within combustion chambers of the rotational engine.

* * * * *